US009136570B2

(12) United States Patent
Hershtig

(10) Patent No.: US 9,136,570 B2
(45) Date of Patent: Sep. 15, 2015

(54) HIGH Q SURFACE MOUNT TECHNOLOGY CAVITY FILTER

(75) Inventor: Rafi Hershtig, Salisbury, MD (US)

(73) Assignee: K & L Microwave, Inc., Salisbury, MD (US)

( * ) Notice: Subject to any disclaimer, the term of this patent is extended or adjusted under 35 U.S.C. 154(b) by 896 days.

(21) Appl. No.: 12/329,098

(22) Filed: Dec. 5, 2008

(65) Prior Publication Data

US 2009/0146763 A1 Jun. 11, 2009

Related U.S. Application Data

(60) Provisional application No. 61/012,203, filed on Dec. 7, 2007.

(51) Int. Cl.

| | |
|---|---|
| ***H01P 1/202*** | (2006.01) |
| ***H01P 5/107*** | (2006.01) |
| ***H01P 7/04*** | (2006.01) |
| ***H01P 1/208*** | (2006.01) |

(52) U.S. Cl.
CPC ..... *H01P 1/208* (2013.01); *H01P 5/107* (2013.01); *H01P 7/04* (2013.01)

(58) Field of Classification Search
CPC ..... H01P 1/208; H01P 5/107; H01P 7/04
USPC ..... 333/26, 202, 206–212, 227–231, 33, 333/222–224
See application file for complete search history.

(56) References Cited

U.S. PATENT DOCUMENTS

| | | | | |
|---|---|---|---|---|
| 3,538,463 | A * | 11/1970 | Pakan | 333/202 |
| 4,431,977 | A * | 2/1984 | Sokola et al. | 333/206 |
| 4,829,274 | A * | 5/1989 | Green et al. | 333/202 |
| 4,879,533 | A * | 11/1989 | de Muro et al. | 333/206 |
| 5,010,309 | A * | 4/1991 | Manssen et al. | 333/206 |
| 5,124,675 | A * | 6/1992 | Komazaki et al. | 333/204 |
| 5,329,687 | A * | 7/1994 | Scott et al. | 29/527.2 |
| 5,550,519 | A * | 8/1996 | Korpela | 333/207 |
| 5,905,416 | A * | 5/1999 | Schmid et al. | 333/134 |
| 6,133,808 | A * | 10/2000 | Arakawa | 333/134 |
| 6,255,921 | B1 * | 7/2001 | Arakawa et al. | 333/208 |
| 7,466,970 | B2 * | 12/2008 | Niiranen et al. | 455/286 |
| 8,063,316 | B2 * | 11/2011 | Gorcea | 174/262 |
| 2002/0021197 | A1 * | 2/2002 | Elco | 333/248 |
| 2002/0145490 | A1 * | 10/2002 | Sauder et al. | 333/202 |
| 2005/0088258 | A1 * | 4/2005 | Fischer | 333/204 |
| 2005/0217786 | A1 * | 10/2005 | Geller et al. | 156/89.11 |
| 2006/0024707 | A1 * | 2/2006 | Deans et al. | 435/6 |
| 2008/0100402 | A1 * | 5/2008 | Rogozine | 333/206 |
| 2009/0160430 | A1 * | 6/2009 | Brown et al. | 324/76.23 |

* cited by examiner

*Primary Examiner* — Robert Pascal
*Assistant Examiner* — Gerald Stevens
(74) *Attorney, Agent, or Firm* — Banner & Witcoff, Ltd.

(57) ABSTRACT

A cavity filter device includes a micro-strip structure comprising a low dielectric organic material forming a printed wiring board. The printed wiring board may be soldered, welded, or adhered to the base of one or more cavity filters. The cavity filter may include a coupling pin such as a RF pin positioned at the base of the filter. The micro-strip structure may be configured to carry a RF signal from the input, across the micro-strip structure to the RF pin positioned at the base of the filter.

21 Claims, 4 Drawing Sheets

Wideband Response

Narrowband Response

HIGH Q SURFACE MOUNT TECHNOLOGY CAVITY FILTER

FIELD OF THE INVENTION

The invention relates generally to apparatus and methods related to cavity filters and more particularly to leadless surface mount technology cavity filters.

BACKGROUND OF THE INVENTION

Miniaturization of surface mount technology components in the area of cavity filters is difficult to accomplish with any degree of acceptable component Insertion-Loss. While high Q components offer increased range and/or reduced noise, these components are often too costly and too large for the given application. Further, while miniaturized components often meet the mechanical and cost specifications, conventionally, they could not be constructed with sufficiently high Q to increase range and reduce noise. It has been found that the use of a Lead-Less SMT air cavity filter solves the above mentioned problems.

SUMMARY OF THE INVENTION

In a first embodiment of an aspect of the invention, a cavity filter device includes a micro-strip structure comprising a low dielectric organic material forming a printed wiring board. The printed wiring board may be soldered, welded, or adhered to the base of one or more cavity filters. The cavity filter may include a coupling pin such as a RF pin positioned at the base of the filter. The micro-strip structure may be configured to carry a RF signal from the input, across the micro-strip structure to the RF pin positioned at the base of the filter.

In a first method, the filter may be adapted for particular performance criteria using planar simulators, such as Sonnet. Applying a suitable configuration such as the foregoing, the transition is analyzed over a wide frequency range and its S-parameters are stored. In exemplary embodiments, the filter is designed to suite the RF specifications and optimized between the stored S-parameters at both of its ports. In this manner, the filter may be matched between two complex loads by changing the internal impedance and couplings between the resonators. In addition, the correct tap point to the first and last resonators may be obtained, for example, by modeling all the transition between the S-parameters and the filter.

Between the I/O ports, the printed wiring board may include and preferably is filled with plated-through-holes to ensure sufficient isolation. This configuration helps reduce the rejection, which is a typical problem of surface mount technology filters. The assembly of the filter and the associated printed wiring board adopter may employ SN-96 solder which may be configured with a melting range of 221 c-229 c. This further enable the complete unit to be solder reflowed into the end product with SN-63.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
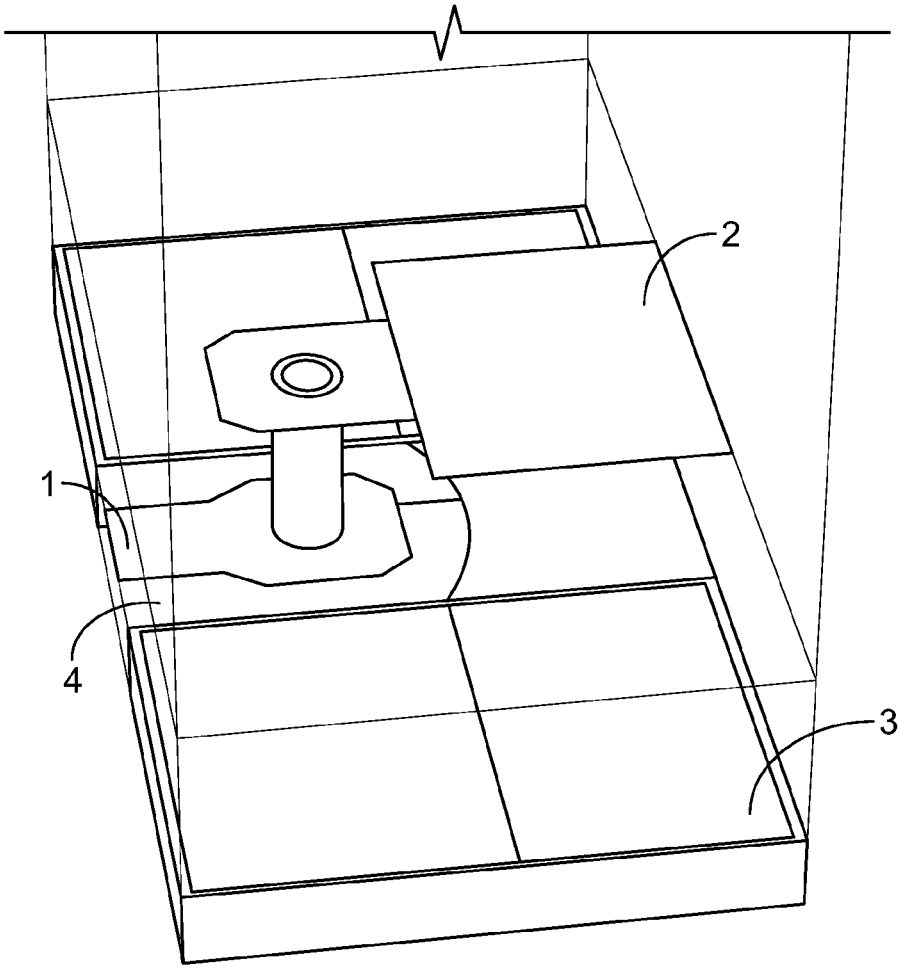
FIG. 1 shows a pictorial view of the surface mount cavity filter.

Referring to FIG. 1, a first exemplary embodiment of a leadless surface mount technology cavity filter is shown. In this embodiment, a graphic representation is shown of a surface mount technology transition from a RO4003 (13 mils) to FV Cavity through RO4003 (31 mils). In this manner, the signal flow of the RF from the printed wiring board to the cavity filter may be accomplished with very little loss. For example, a first connection 1 coupled to a RF pin with then may be coupled to the base of the cavity filter with very little loss.

Figure 2:
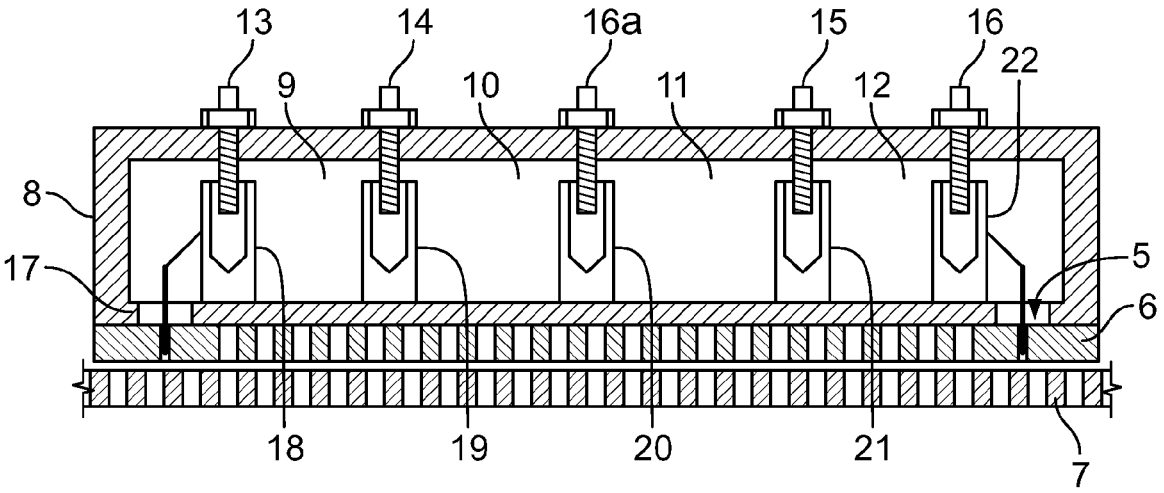
FIG. 2 shows a cross sectional view of the cavity filter.

FIG. 2 shows a cross sectional view of one embodiment of the leadless surface mount technology cavity filter. In this embodiment, a cavity filter 8 is disposed on a printed wiring board 7. Coupled between the printed wiring board 7 and the cavity filter 8 is a printed wiring adaptor 6. RF Pins 5, 17, may be coupled at opposite ends of the cavity filter. The cavity filter may be variously configured to include a plurality of cavities 9, 10, 11, 12, with or without various tuning screws such as 13, 14, 15, 16, 16*a* disposed in apertures 18, 19, 20, 21, 22 which are disposed between cavities.

Figure 3:
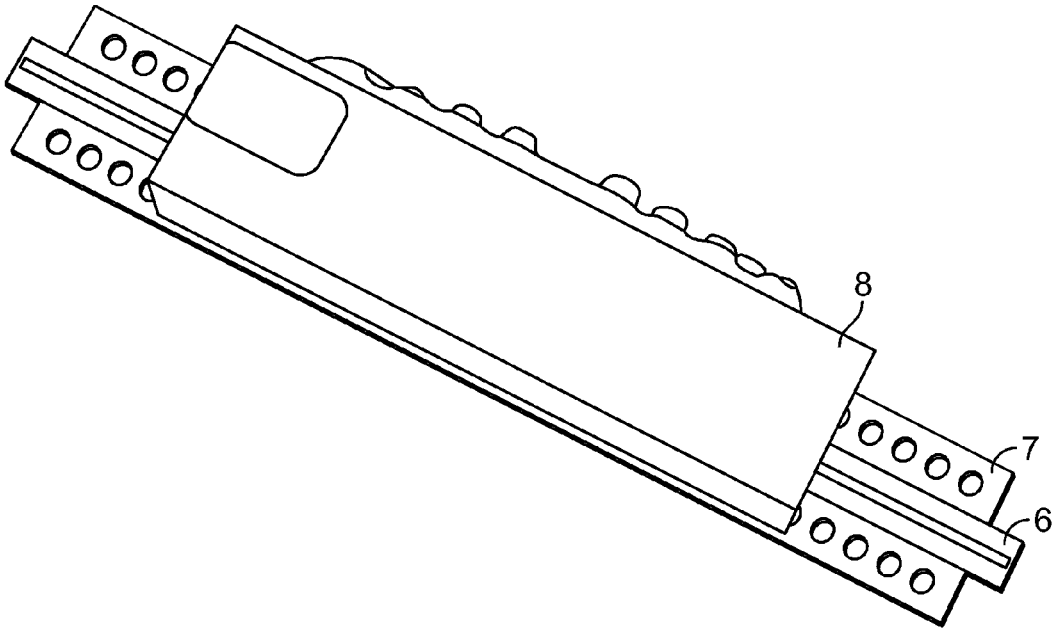
FIG. 3 shows a top planer view of the cavity filter.

FIG. 3 shows an exemplar top planar view of the surface mount cavity filter 8 having tuning screws output from the top, the printed wiring board 7, and the RF pins 5, 17.

Figure 4:
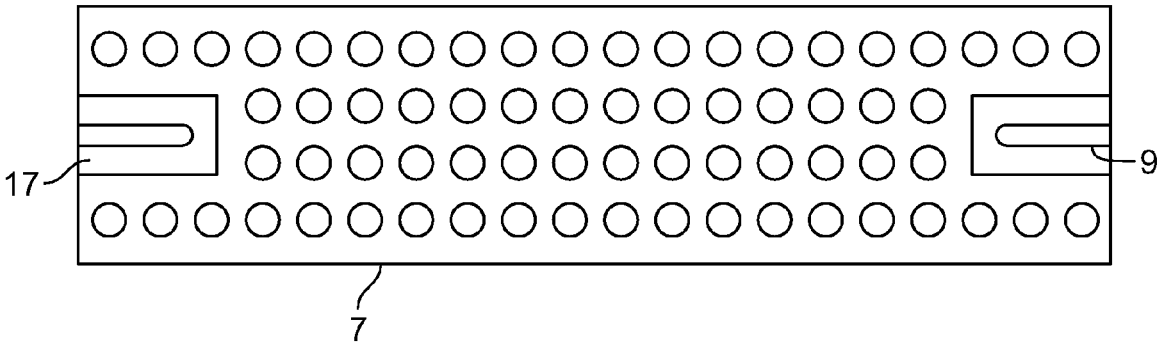
FIG. 4 shows a bottom planar view of the printed wiring board of the surface mount cavity filter.

FIG. 4 shows the bottom side of the printed wiring board having the through vias. The printed wiring board may be a Rogers RO4003 having a suitable thickness such as about 0.012", with ½ ounce of copper on both sides of the board. The length may be about 0.5, 1, 1.5, 2.0, 2.5, or larger. The width may be 0.15, 0.20, 0.25, 0.30, 0.38, 0.45, 0.50, or 0.60 or larger.

Figure 5:
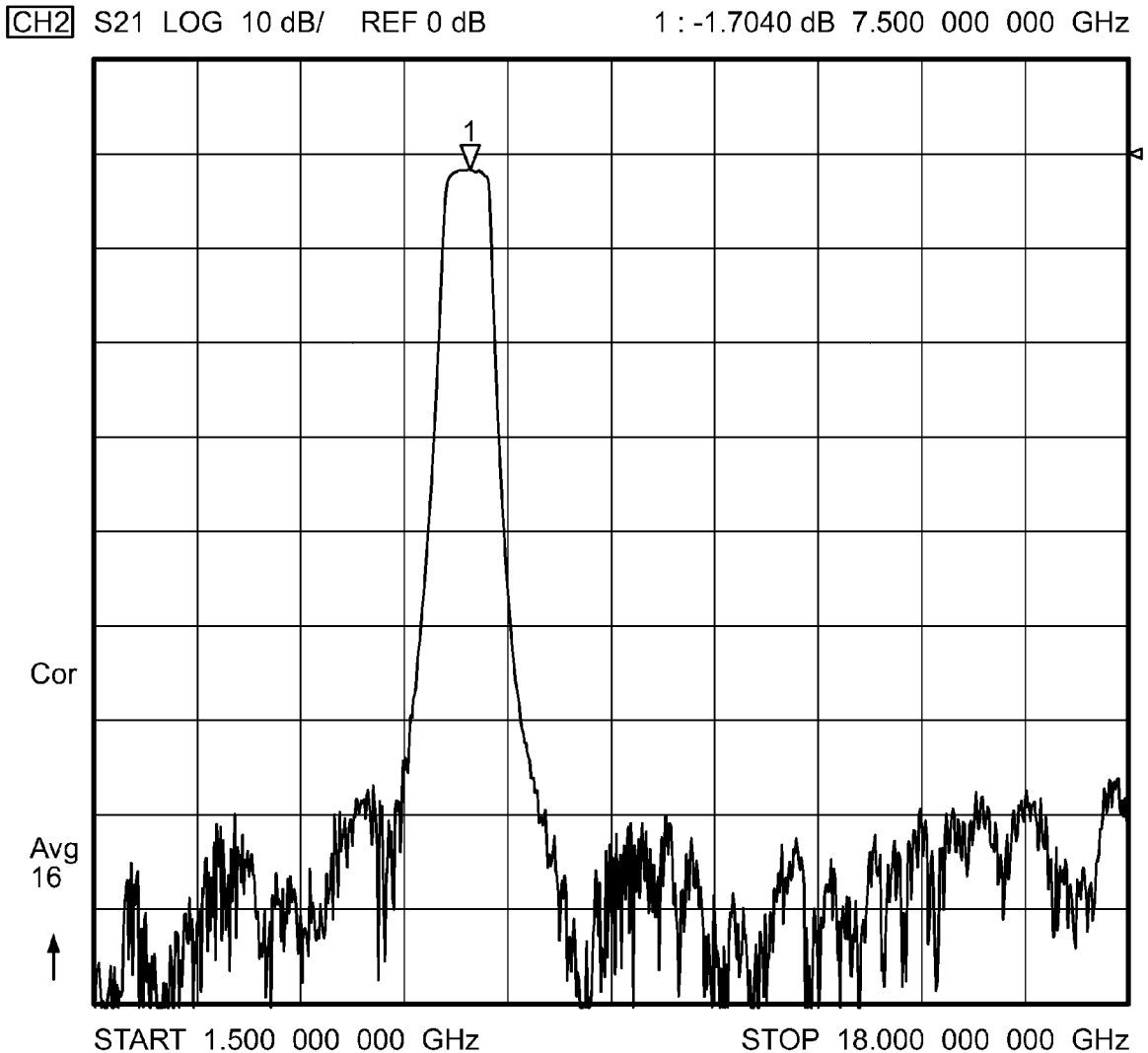
FIG. 5 shows an exemplary wide band response for the surface mount cavity filter.

Referring to FIG. 5, a wide band response is shown. Note the very desirable response curve exhibited by the filter.

Figure 6:
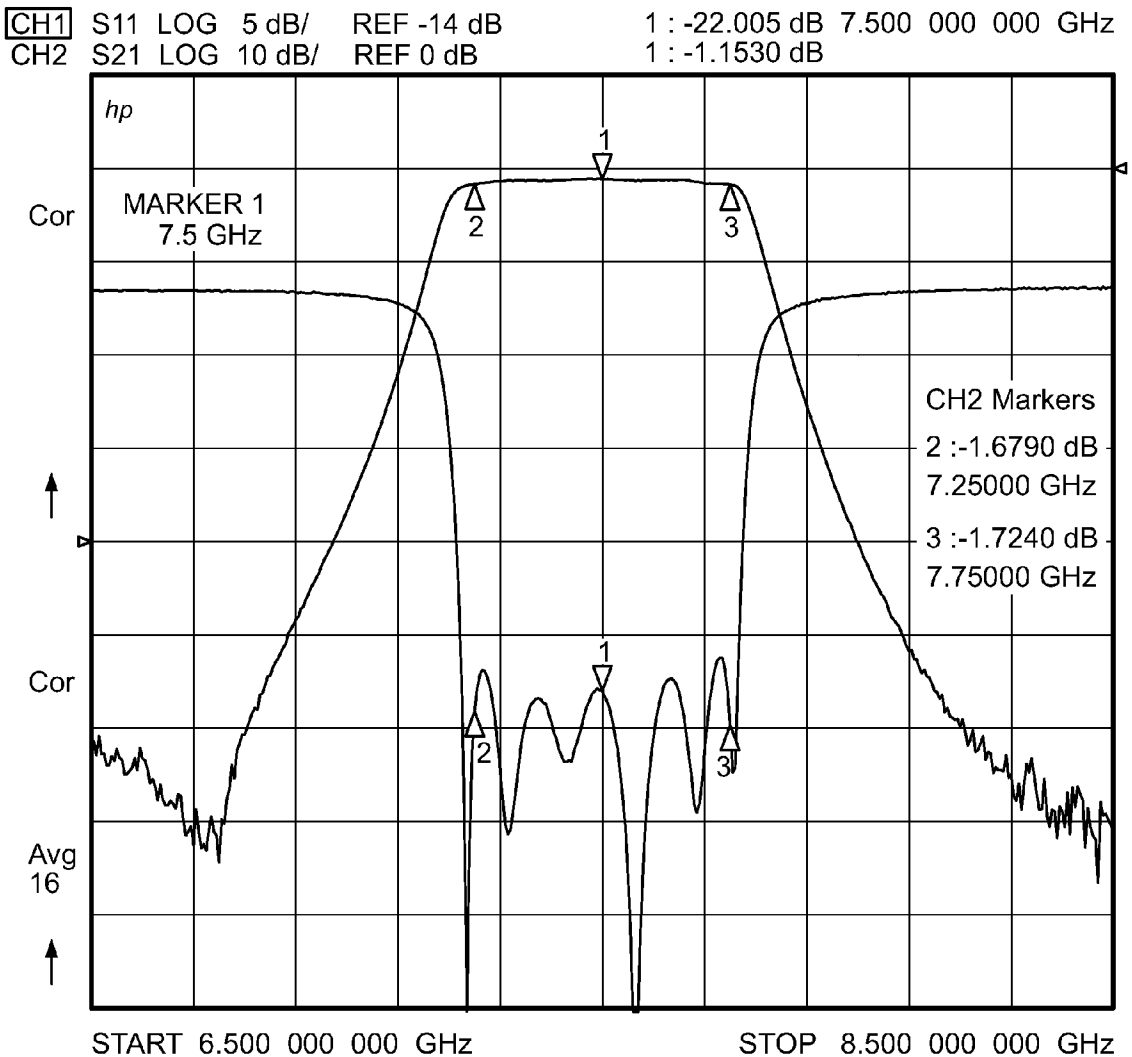
FIG. 6 shows a narrow band response of the surface mount cavity filter.

Referring to FIG. 6, the narrow band response is shown. Again, the filter results in a very favorable narrow band response.

The transition from the printed wiring board to the rf pins is encapsulated in a suitable material such as epoxy. This enables the cavity filter to have excellent matching characteristics and keeps the ultimate rejection levels down. The resulting cavity filter offers high Q, and a low-loss response that was heretofore not possible with surface mount technologies. The use of a leadless carrier saves connector space and yet still provides good transitions for all types of filters.

As shown in the above FIGS. 1-4, a cavity filter device includes a micro-strip structure comprising a low dielectric organic material forming a printed wiring board. The printed wiring board may be soldered, welded, or adhered to the base of one or more cavity filters. The cavity filter may include a coupling pin such as a RF pin positioned at the base of the filter. The micro-strip structure may be configured to carry a RF signal from the input, across the micro-strip structure to the RF pin positioned at the base of the filter.

In a first method employing the cavity filter shown in FIGS. 1-4 may include one or more of the following. First, the filter may be adapted for particular performance criteria using planar simulators, such as Sonnet. Applying a suitable configuration such as the foregoing, the transition is analyzed over a wide frequency range and its S-parameters are stored. In exemplary embodiments, the filter is designed to suite the RF specifications and optimized between the stored S-parameters at both of its ports.

In this manner, the filter may be matched between two complex loads by changing the internal impedance and couplings between the resonators. In addition, the correct tap point to the first and last resonators may be obtained, for example, by modeling all the transition between the S-parameters and the filter.

In embodiments shown in FIGS. 1-4, between the I/O ports, the printed wiring board may include and preferably is filled with plated-through-holes to ensure sufficient isolation. This configuration helps reduce the rejection, which is a typical problem of surface mount technology filters. The assembly of the filter and the associated printed wiring board adapter may employ SN-96, which may be configured with a melting range of 221c -229c. This further enables the complete unit to be solder reflowed into the end product with SN-63.

The invention claimed is:

1. An apparatus comprising:

a surface mount filter including a radio frequency (RF) pin;

an air cavity filter coupled to the RF pin and configured to attenuate an RF signal provided from the RF pin;

a micro-strip structure comprising an input for the micro-strip structure, an output coupled to the RF pin, a low dielectric material, and a plurality of through holes disposed along the micro-strip structure for isolating the input; and a transition from the micro-strip structure to the air cavity filter including a material encapsulating the RF pin.

2. The apparatus of claim 1, wherein the air cavity filter is a comb-line cavity filter.

3. The apparatus of claim 1, wherein the surface mount filter further includes a printed wiring board, wherein the air cavity filter is coupled to the printed wiring board via solder, welding, or adhesive, and wherein the micro-strip structure forms a part of the printed wiring board.

4. The apparatus of claim 1, the air cavity filter comprising:

a plurality of separate cavities; and one or more apertures disposed between the plurality of separate cavities.

5. The apparatus of claim 4, the air cavity filter further comprising:

one or more tuning screws, each tuning screw associated with one of the one or more apertures, said tuning screws positioned on an opposite surface of the air cavity filter from the micro-strip structure.

6. The apparatus of claim 1, wherein the surface mount filter further includes at least a second RF pin coupled to the air cavity filter at an opposite end from where the RF pin is coupled to the air cavity filter.

7. The apparatus of claim 6, wherein the material comprises epoxy.

8. The apparatus of claim 1, wherein the surface mount filter is a leadless surface mount filter configured to carry the RF signal provided to the input across the micro-strip structure to the RF pin via the output.

9. The apparatus of claim 8, wherein the RF pin is arranged to provide a direction of signal flow to the air cavity filter different from a direction of signal flow across the micro-strip structure.

10. The apparatus of claim 9, wherein the direction of signal flow to the air cavity filter is perpendicular to the direction of signal flow across the micro-strip structure.

11. The apparatus of claim 1, wherein the air cavity filter is a Transverse Electromagnetic (TEM) mode cavity filter.

12. The apparatus of claim 1, wherein the surface mount filter is a leadless surface mount filter.

13. A method comprising:

providing a micro-strip structure comprising an input for the micro-strip structure, an output, a low dielectric material, and a plurality of through holes disposed along the micro-strip structure for isolating the input;

coupling an air cavity filter to a surface of the micro-strip structure via a transition such that (a) the transition couples a radio frequency (RF) pin to the output and the air cavity filter, and (b) the coupling configures a flow of an RF signal from the output to the air cavity, via the RF pin, for attenuation by the air cavity filter; and after the coupling of the air cavity filter to the surface of the micro-strip structure, providing a surface mount filter comprising the micro-strip structure and the air cavity filter.

14. The method of claim 13, wherein the air cavity filter is a comb-line cavity filter.

15. The method of claim 13, wherein the air cavity filter comprises a plurality of separate cavities and one or more apertures disposed between the plurality of separate cavities.

16. The method of claim 15, wherein the air cavity filter further comprises one or more tuning screws, each tuning screw associated with one of the one or more apertures, and wherein said tuning screws are positioned on an opposite surface of the air cavity filter from the micro-strip structure.

17. The method of claim 13, wherein the coupling of the air cavity filter to the surface of the micro-strip structure is performed such that the transition couples a second RF pin to the air cavity filter at an opposite end from where the RF pin is coupled to the air cavity filter.

18. The method of claim 17, further comprising:

encapsulating the RF pin in epoxy.

19. The method of claim 13, wherein the surface mount filter is a leadless surface mount filter configured to carry the RF signal provided to the input across the micro-strip structure to the RF pin via the output.

20. The method of claim 13, wherein the air cavity filter is a Transverse Electromagnetic (TEM) mode cavity filter.

21. The method of claim 13, wherein the surface mount filter is a leadless surface mount filter.

* * * * *